United States Patent [19]

Hofeler

[11] Patent Number: 4,577,453

[45] Date of Patent: Mar. 25, 1986

[54] METHOD OF AND APPARATUS FOR FORMING AND CARTONING MULTI-STACK ARRAYS OF COMPRESSIBLE ARTICLES

[75] Inventor: Henry H. Hofeler, Cincinnati, Ohio

[73] Assignee: The Procter & Gamble Company, Cincinnati, Ohio

[21] Appl. No.: 576,097

[22] Filed: Feb. 1, 1984

[51] Int. Cl.[4] ..... B65B 63/02

[52] U.S. Cl. ..... 53/438; 53/443; 53/529; 53/543; 414/907

[58] Field of Search ..... 53/438, 436, 443, 523, 53/529, 538, 543, 544; 100/237; 414/907

[56] References Cited

U.S. PATENT DOCUMENTS

| | | | |
|---|---|---|---|
| 2,324,930 | 7/1943 | Joa | 226/14 |
| 3,383,825 | 5/1968 | Titchenal et al. | 53/438 |
| 3,608,269 | 9/1971 | Gore | 53/529 X |
| 3,876,083 | 4/1975 | Evans et al. | 214/7 |
| 4,028,864 | 6/1977 | Bell | 53/438 |
| 4,056,919 | 11/1977 | Hirsch | 53/124 |
| 4,141,193 | 2/1979 | Joa | 53/529 |
| 4,241,562 | 12/1980 | Meyer | 53/438 |
| 4,250,688 | 2/1981 | Lingenfelder | 53/529 X |
| 4,399,905 | 8/1983 | Lance | 198/422 |

FOREIGN PATENT DOCUMENTS

| | | | |
|---|---|---|---|
| 2702339 | 7/1978 | Fed. Rep. of Germany | 53/544 |

*Primary Examiner*—John Sipos

*Assistant Examiner*—Steven P. Weihrouch

*Attorney, Agent, or Firm*—Thomas J. Slone; Fredrick H. Braun; Richard C. Witte

[57] ABSTRACT

The apparatus forms multi-stack arrays of compressible, generally flat articles—for example, elongate catamenial napkins—on a receiving platform disposed adjacent a stack forming apparatus by pushing one stack against the back wall of the receiving platform, and then pushing successively formed stacks into adjacent relation with the last stack pushed onto the receiving platform. This is done with a stack pusher, and controlling the lengths of its successive strokes as required. Upon moving each stack into its respective position on the receiving platform, it is individually compressed to reduce the height of the stack to about the height of the carton into which the array is to be loaded as a unit. An array pusher then pushes the array orthogonally with respect to the direction of pushing the stacks onto the receiving platform to displace the array as a unit into a carton through a loading funnel. Preferably, elongate articles such as catamenial napkins are oriented in the associated stacker so that, relative to the length dimension of the articles, the stacks are displaced sideways from the stacker onto the receiving platform so that the stacks are oriented in side-by-side relation with each other. Individual compression of each stack substantially obviates any interleaving or damage of the articles in adjacent stacks which might otherwise occur: particularly at high stack pusher velocities.

8 Claims, 10 Drawing Figures

METHOD OF AND APPARATUS FOR FORMING AND CARTONING MULTI-STACK ARRAYS OF COMPRESSIBLE ARTICLES

DESCRIPTION

1. Technical Field

This invention pertains to stacking articles, and unitarily placing multi-stack arrays of the articles in cartons. More particularly it pertains to doing so with substantially flat articles such as elongate catamenial napkins which are compressible and lack stiff vertical sides inasmuch as such articles are somewhat susceptible to interleaving and damage when one stack is pushed against another at high velocity.

2. Background Art

An Apparatus For Alternately Forming And Forwarding Atacks Of Articles is disclosed in U.S. Pat. No. 4,399,905 which issued Aug. 23, 1983 to Lance et al. Stacks of substantially flat articles are formed in vertically spaced ways, and then stripped unitarily from between the ways by a pusher which is compatibly configured with respect to the ways, and which is pneumatically operated while the ways are stopped: i.e., spatially arrested.

A Stacking And Boxing Apparatus is disclosed in U.S. Pat. No. 2,324,930 which issued July 20, 1943 to C. G. Joa in which apparatus successive vertical stacks of articles are formed and pushed between top and bottom plates of a receiver. In this apparatus, a carton-load array of three stacks is marshalled by the second stack pushing the first; and then the third stack pushing the first and the second stacks. The carton-load array is then unitarily forwarded into an awaiting carton by an array pusher.

A Diaper Packer is disclosed in U.S. Pat. No. 4,056,919 which issued Nov. 8, 1977 to John L. Hirsch. This apparatus comprises means for receiving stacks of articles from a stacker of the type disclosed in Lance et al, and accomodating successive stacks in side-by-side bins which bins are successively positioned in line with the stacker discharge by a lateral schuttle means. The individual stacks are then compressed while each is still in a discrete bin; and the side-by-side stacks (i.e., a two stack array) are then pushed unitarily out of the side-by-side bins.

A Machine For Packaging Flexible Articles is disclosed in U.S. Pat. No. 3,876,083 which issued Apr. 8, 1975 to Stephen F. Evans and Eugene R. Sorensen. In this apparatus, successive stacks are removed laterally from an intermittently rotated stack wheel after being lilghtly compressed while on the stacker wheel. The stacks are then guided between upper and lower plates until they are pushed by a second pusher into an awaiting carton.

3. Disclosure of the Invention

In accordance with one aspect of the invention, an apparatus for forming and cartoning multi-stack arrays of compressible, generally flat articles is provided which comprises a receiving platform having a back wall, a variable stroke stack pusher for forwarding successive stacks of the articles from stack forming means onto the receiving platform along a first path, means for marshalling such an said array by cyclically controlling the stack pusher in timed relation with the stack forming means to forward a first stack from the stack forming means to abutting relation with the back wall of the receiver platform and to forward successive stacks of the array into abutting relation with the last preceeding stack of the array being marshalled. The apparatus further comprises a discrete stack compressor for each of the stacks of the marshalled array, and means for controlling the stack compressors so that each stack is compressed to a predetermined height on the receiving platform prior to the arrival of the next successive stack of the array: indeed, preferably before the stack pusher is retracted after moving the last-to-arrive stack onto the receiving platform. Additionally, the apparatus comprises means for unitarily pushing the marshalled array of individually compressed adjacent stacks along a second path orthogonally related to the first path to forward the array into a carton: preferably through a loading funnel, and preferably prior to retracting the stack pusher and stack compressors after the last stack of the array has been forwarded onto the receiving platform.

BRIEF DESCRIPTIONS OF THE DRAWINGS

While the specification concludes with claims which particularly point out and distinctly claim the subject matter regarded as forming the present invention, it is believed the invention will be better understood from the following descriptions taken in conjunction with the accompanying drawings in which identical features in the several views are identically designated and in which:

DETAILED DESCRIPTION OF THE INVENTION

Figure 1:
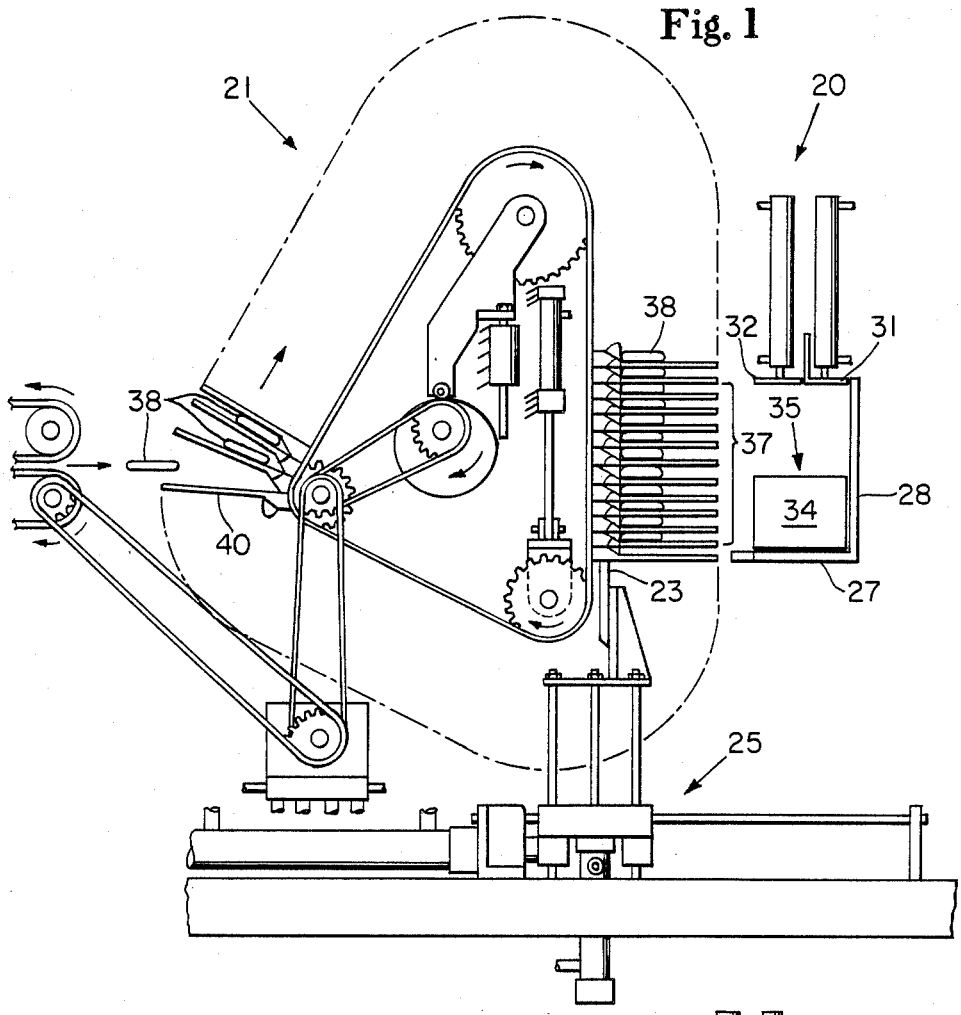
FIG. 1 is a fragmentary side elevational view of an apparatus embodiment of the present invention.

An apparatus 20 which is an embodiment of the present invention is shown in FIG. 1 to comprise a stacker 21, a stack pusher 23, means 25 for cyclically moving the stack pusher through a sequence of strokes of predetermined lengths, a receiving platform 27 having a back wall 28, two independent stack compressors 31 and 32, and a pusher plate 34 of an array pusher which is generally indicated by the arrow 35 but otherwise hidden from view in FIG. 1 behind its pusher plate 34. Additionally, apparatus 20 comprises drive and control means not shown for cyclically operating the components of the apparatus in timed relation to form predetermined multi-stack arrays of the articles to be unitarily cartoned, and to carton those arrays in accordance with the method described hereinafter.

Stacker 21, FIG. 1, comprises means for assembling or forming a stack 37 having a predetermined count of generally flat articles 38 disposed between vertically spaced ways 40, and positioning the stack with its bottom end at the same elevation as the receiving platform 27 while the stack is stripped from between the ways by stack pusher 23. Upon returning the stack pusher to its retracted position (i.e., the position shown in FIG. 1), the stacker proceeds to cyclically form successive stacks, and have them forwarded onto the receiving platform. A suitable stacker is disclosed in the Lance et al patent referenced hereinabove although it is not intended to limit the present invention to only that particular stacker.

FIGS. 2 through 8, inclusive, are sequential fragmentary views of the apparatus of FIG. 1 which depict the major steps of the apparatus which are visible in the side elevational views. The sequence of marshalling a carton-load array of two stacks in the apparatus will be described by briefly describing FIGS. 2 through 8 in numerical order. Then, the remainder of the sequence of the apparatus—i.e., forwarding the carton-load array into a carton—will be discussed by referring to FIGS. 9 and 10 which are sequential fragmentary plan views of the apparatus. To avoid undue redundancy, only the positional changes which have occured from Figure to Figure will be delineated as the apparatus sequence is described.

Figure 2:
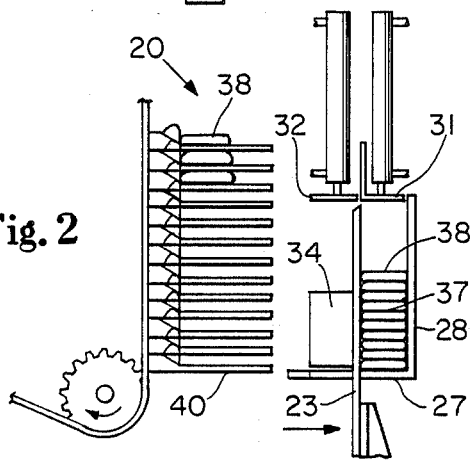
FIGS. 2 through 8 are fragmentay views of the apparatus shown in FIG. 1 and show a portion of the cyclical sequence of the apparatus: up to having an array of two side-by-side compressed stacks marshalled on the receiving platform.

FIG. 2 shows a fragmentary portion of apparatus 20 after a stack 37 of articles 38 have been forwarded from between the ways 40 by a first extension stroke of stack pusher 23 to place the stack in abutting relation with back wall 28.

Figure 3:
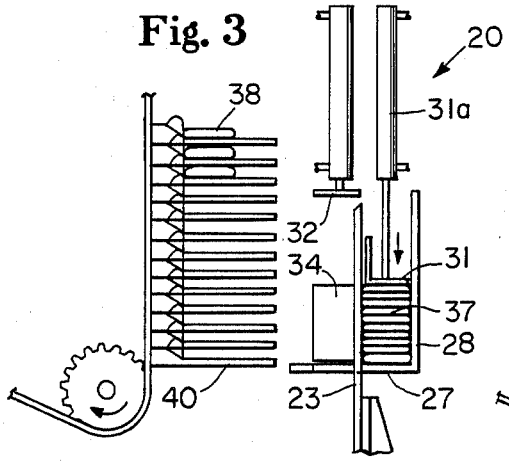

FIG. 3 shows a fragmentary portion of apparatus of FIG. 2 after stack compressor 31 has been extended by actuator 31*a* to compress the stack 37 to reduce its height to about the height of a carton into which the stack will ultimately be forwarded.

Figure 4:
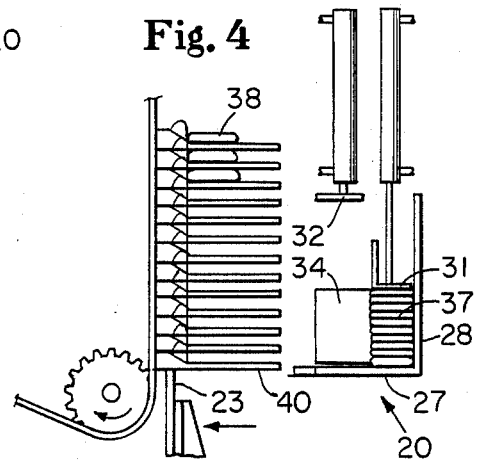

FIG. 4 shows the fragmentary portion of apparatus 20 of FIG. 3 after the stack pusher 23 has been retracted to its position in FIG. 1; its fully retracted position.

Figure 5:
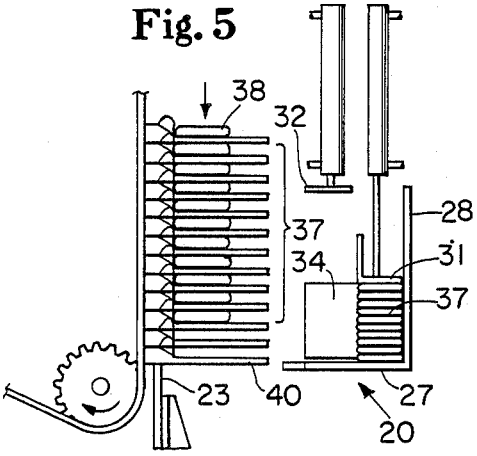

FIG. 5 shows the fragmentary portion of apparatus 20 of FIG. 4 after the stacker has begun to lower the next successive stack 37 of articles to the elevation of the receiving platform 27.

Figure 6:
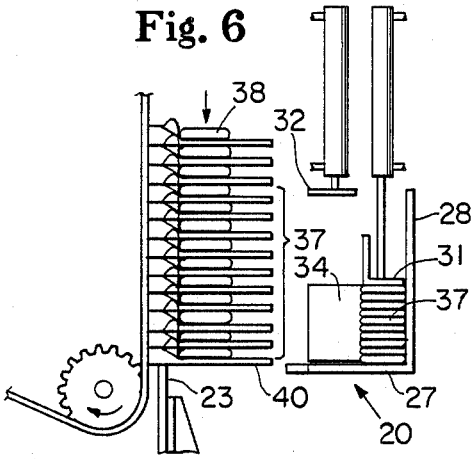

FIG. 6 shows the fragmentary portion of apparatus 20 of FIG. 5 after the next successive stack (i.e., the second stack of the two stack array which is being marshalled) has been lowered in vertically spaced ways 40 to the elevation of the receiving platform 27.

Figure 7:
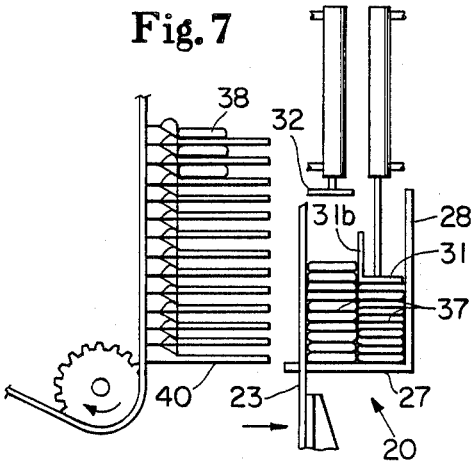

FIG. 7 shows the fragmentary portion of apparatus of FIG. 6 after the second stack 37 has been forwarded from between the ways 40 by another, shorter stroke of stack pusher 23 to place the second stack in abutting relation with the first stack. This second stroke of the stack pusher is shorter than its first stroke by an amount equal to the width of the first stack. Additionally, FIG. 7 reveals the purpose for the shoe of stack compressor 31 to be L-shaped: the upwardly extending portion of the shoe of 31 is designated abuttment 31*b* and serves as a stop for the articles of the second stack which are at a higher elevation than the top of the compressed first stack. The abuttment enables the top portion of the second stack to remain columnar, and is very important with respect to achieving high throughput of apparatus 20. That is, were abuttment 31*b* not present, a high velocity stroke of stack pusher would throw the top articles in the stack into such a disarray that the apparatus might jam or have to be stopped to clear the disarray. Clearly, packaged disarrays are not desireable from a consumer preference viewpoint.

Figure 8:
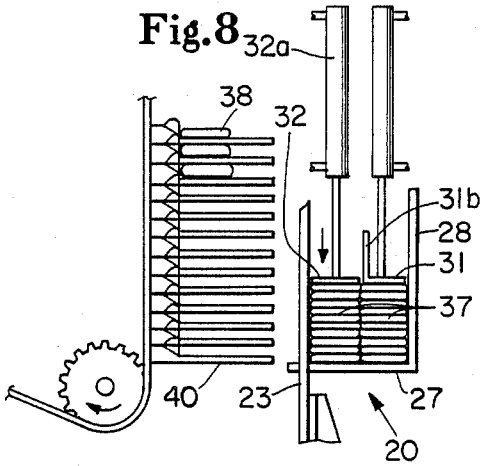

FIG. 8 shows the fragmentary portion of the apparatus 20 of FIG. 7 after the second stack compressor 32 has been extended downwardly by its actuator 32*a* to reduce the height of the second stack 37 as was done with the first stack: that is to reduce its height to about the height of the carton into which the array is to be loaded. Additionally, it is clear in FIG. 8 that the two stack array will be guided by the cooperative surfaces of stack pusher 23, receiving platform 27, back wall 28, and the shoes of stack compressors 31 and 32 when the array pusher pushes the array into a carton as will be described next.

Figure 9:
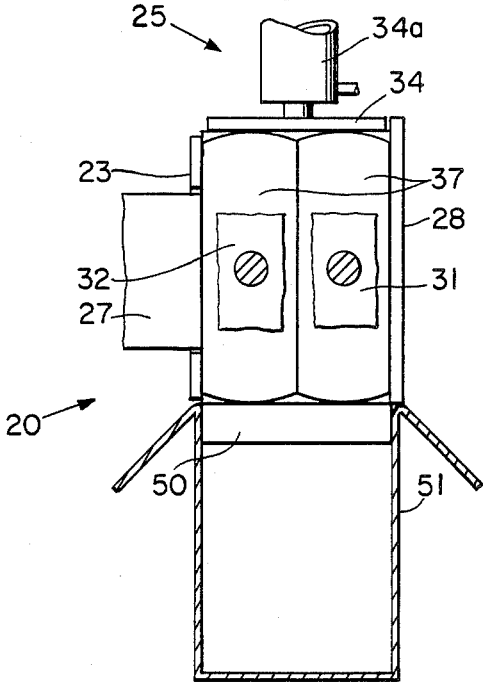
FIGS. 9 and 10 are sequential, fragmentary plan views of the apparatus shown in FIG. 1 and show furthering the cycle of the apparatus depicted in FIGS. 1 through 8.

Essentially, FIG. 9 is a plan view of the fragmentary portion of apparatus 20 of FIG. 8, and to which has been added a loading funnel 50 and an empty carton 51 having its open end telescoped over the loading funnel. Additionally, FIG. 9 shows the actuator 34*a* for cyclically moving the pusher plate 34 of the array pusher 35 between its retracted position as shown and an extended position; and portions of stack compressors have been cut away along to more clearly show the plan-view shape of the articles in stacks 37.

Figure 10:
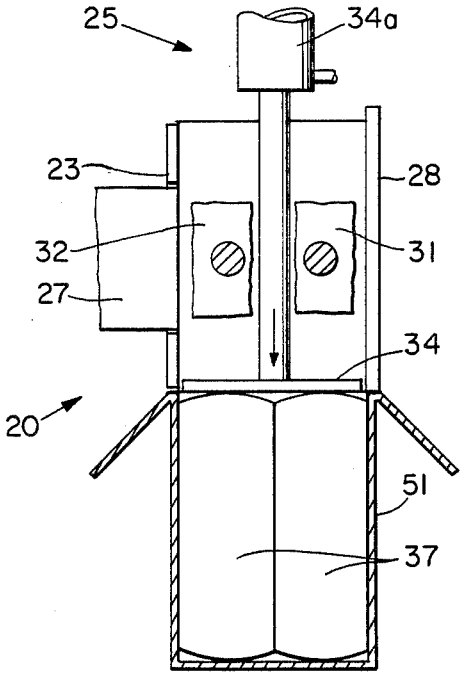

FIG. 10 shows the fragmentary portion of apparatus 20 of FIG. 9 after the actuator 34*a* of the array pusher 35 has been extended sufficiently to cause the array pusher plate 34 to push the two-stack array into carton 51 through loading funnel 50. Preferably, the actuator will be controlled to extend sufficiently further to dislodge the filled carton from the loading funnel and onto a takeaway conveyor or other apparatus for filled cartons.

Upon completing the cartoning of the array, the array pusher is retracted to its FIG. 9 position; and the stack compressors 31 and 32, and the stack pusher are retracted to their FIG. 1 positions to commence another array marshalling and cartoning cycle of apparatus 20. In this regard, it is noted that although the exemplary apparatus 20 described above is configured to marshal and carton two-stack arrays, it is not intended to thereby limit the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An apparatus for forming a cartoning multi-stack arrays of compressible elongate articles having elongate side edges, said apparatus comprising means for sequentially forming and marshalling a multi-stack array of stacks of said articles with said stacks in side-by-side abutting relation at predetermined positions on a receiving platform including means for independently horizontally pushing each formed stack along a first path disposed orthogonally with respect to said elongate side edges until it is disposed at its respective predetermined position on said receiving platform, means for independently compressing each of said stacks to a pre-determined height prior to the next successive stack being pushed to its respective position in said array for forming an abutting stop for the next successive stack and for obviating interleaving of said articles of said next successive stack with said articles of the preceding said stack, and means for unitarily pushing said array into an empty carton having a height substantially equal to said predetermined height.

2. The apparatus of claim 1 wherein said means for forming and marshalling said stacks of articles comprises a back wall on said receiving platform, and a stack pusher for independently forwarding each stack along said first path onto said receiving platform, stack pusher control means for controlling the stroke of said stack pusher so that the first stack of an array is forwarded into abutting relation with said back wall and so that each successive stack is pushed into said side-by-side abutting relation with the last preceding stack of said array, said apparatus further comprising means for controlling said means for independently compressing said stacks so that each said stack is compressed prior to the next successive stack being forwarded into abutting relation therewith.

3. The apparatus of claim 2 wherein said stack pusher control means causes said stack pusher to remain extended in abutting relation with the last stack forward onto said receiving platform until said last stack has been compressed by said compression means.

4. The apparatus of claim 3 wherein said stack pusher control means causes said stack pusher to remain extended in abutting relation with the last stack of said array until said array pusher means forwards said array along a second path orthogonal to said first path to load the array into said carton.

5. The apparatus of claim 2 wherein said means for forming said stacks comprises means for sequentially forming said stacks adjacent said receiving platform.

6. The apparatus of claim 5 wherein said means for sequentially forming said stacks adjacent said receiving platform comprises means for forming said stacks between vertically spaced ways.

7. A method of forming and cartoning multi-stack arrays of compressible elongate articles having elongate side edges, said method comprising the steps of sequentially forming and marshalling a multi-stack array of stacks of articles with said stacks in side-by-side abutting relation by independently pushing each formed stack along a first path disposed orthogonally with respect to said elongate side edges until it is disposed in its respective position in said array being marshalled, independently compressing each of said stacks to a predetermined height prior to the next successive stack being pushed to its respective position in said array for forming an abutting stop for the next successive stack and for obivating interleaving of said articles of said next successive stack with said articles of the preceding said stack, and unitarily pushing said array into an empty carton having a height substantially equal to said predetermined height.

8. The method of claim 7 wherein said array is sequentially formed at an array marshalling location, and said array is unitarily moved along a second path from said marshalling location into an empty carton, said second path being orthogonally disposed with respect to said first path.

* * * * *